73-151.5 SR
4/25/78 XR 4,085,509

United States Patent [19]

Bell et al.

[11] 4,085,509

[45] Apr. 25, 1978

[54] APPARATUS FOR COMPENSATING FOR THE HEAVING OF A FLOATING DRILLING PLATFORM FOR CONNECTION WITH APPARATUS FOR MEASURING THE RATE OF PENETRATION OF PIPE RUN INTO AN OFFSHORE WELL

[75] Inventors: Leo A. Bell; Norbert C. Peterson, both of Santa Ana, Calif.

[73] Assignee: Martin-Decker Company

[21] Appl. No.: 674,490

[22] Filed: Apr. 7, 1976

[51] Int. Cl.[2] ..... G01B 3/12

[52] U.S. Cl. ..... 33/134 R; 73/151.5; 175/7

[58] Field of Search ..... 33/129, 133, 134, 134 A; 73/151.5; 175/40, 7

[56] References Cited

U.S. PATENT DOCUMENTS

| | | | |
|---|---|---|---|
| 2,806,372 | 9/1957 | Arps | 33/134 X |
| 3,891,038 | 6/1975 | Delestrade et al. | 73/151.5 X |
| 3,931,735 | 1/1976 | Guigmard | 73/151.5 |

*Primary Examiner*—Charles E. Phillips
*Attorney, Agent, or Firm*—Pravel, Wilson & Gambrell

[57] ABSTRACT

Apparatus adapted to compensate for the heaving of a floating offshore drilling platform, which heaves relative to the ocean bottom due to wave action of the water in which the platform is floating, which heave-compensation apparatus is adapted to be connected to apparatus for measuring the rate of penetration of pipe run into a well beneath the floating platform. The heave-compensating apparatus nullifies the effect of movement of the drilling platform relative to a stationary object, such as a riser pipe beneath the platform, so that false or erroneous reading on the rate of penetration measuring apparatus is prevented.

12 Claims, 6 Drawing Figures

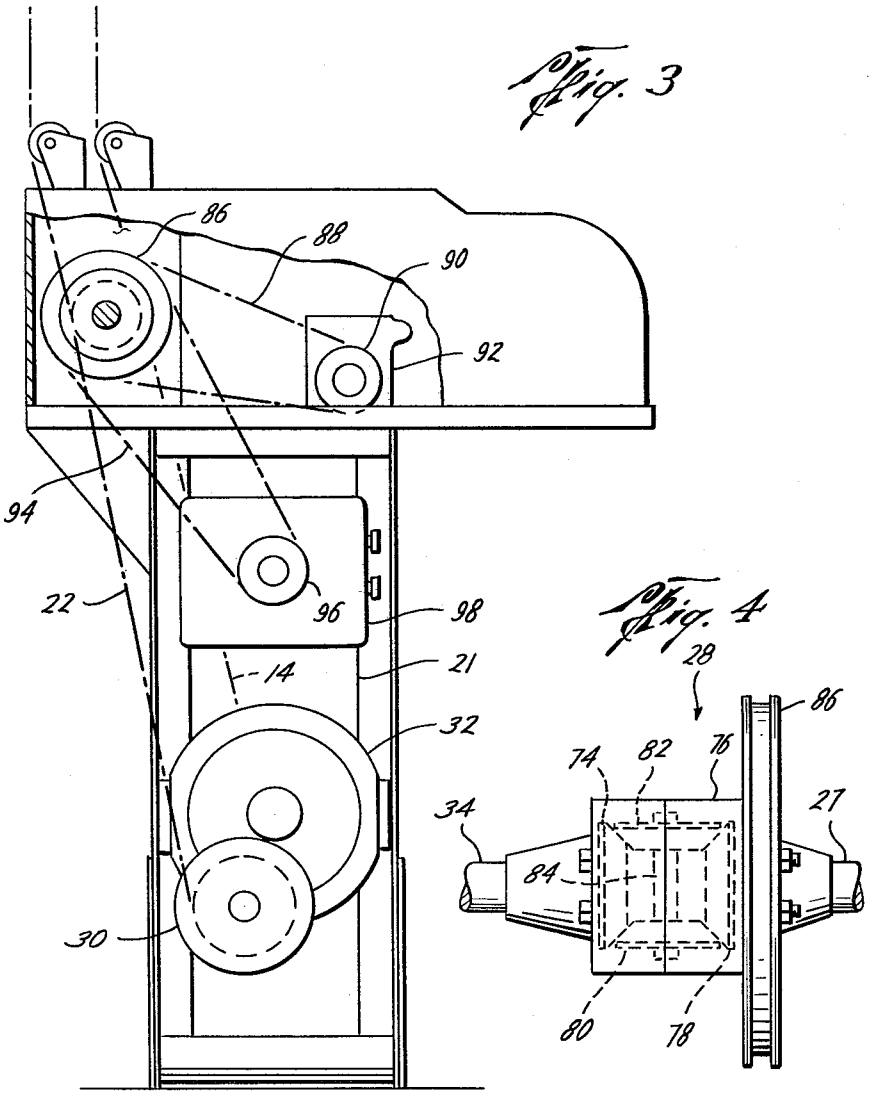
Fig. 3
Fig. 4
86
27
28
76
78
82
74
80
84
34
92
90
88
86
98
21
32
96
14
94
22
30
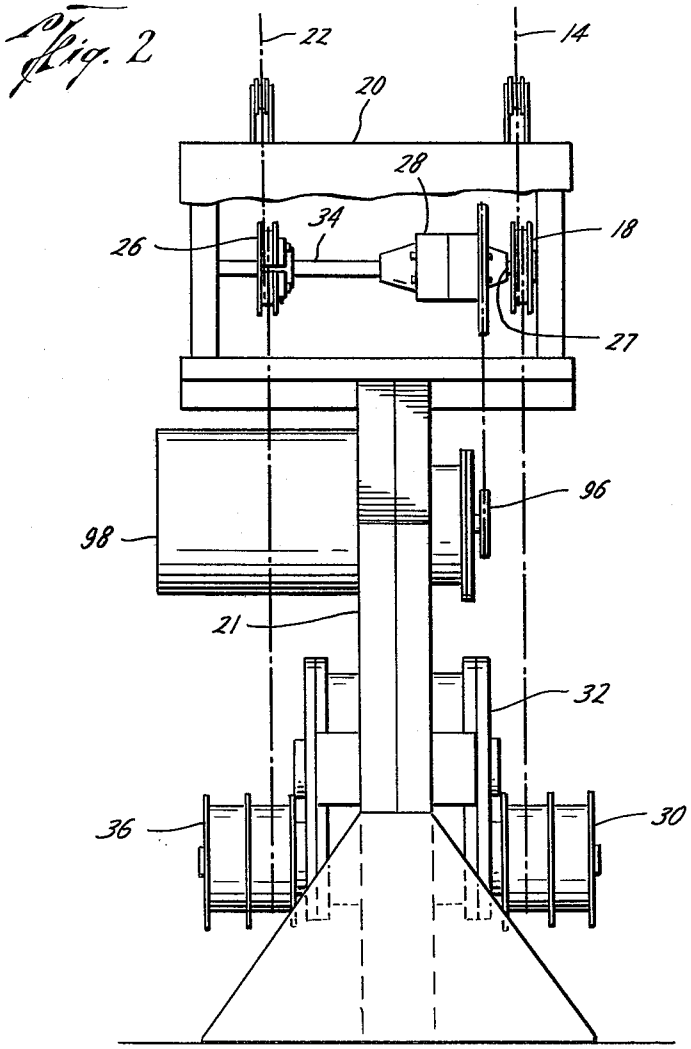
Fig. 2
14
18
27
28
20
22
34
26
96
32
30
21
98
36

APPARATUS FOR COMPENSATING FOR THE HEAVING OF A FLOATING DRILLING PLATFORM FOR CONNECTION WITH APPARATUS FOR MEASURING THE RATE OF PENETRATION OF PIPE RUN INTO AN OFFSHORE WELL

BACKGROUND OF THE INVENTION

1. Field of the Invention

The present invention relates to apparatus for nullifying the effects of the heaving movements of a platform in the measurement of the amount of pipe being run into a well.

2. Description of the Prior Art

In the past, various mechanisms have been developed which measured the amount of pipe being lowered into a well, as exemplified by U.S. Pat. No. 3,747,218. These mechanisms were developed for land-based derrick platforms and are not satisfactory for use on offshore floating drilling platforms since such platforms heave up and down in response to wave action and thereby do not provide a stationary reference point for the measurement of the movement of pipe into a well. Hence, such mechanisms provide false readings of the movement of pipe into off-shore wells.

SUMMARY OF THE INVENTION

Briefly, the present invention provides a new and improved heave-compensation apparatus for use with an apparatus for automatically measuring the rate of penetration of pipe into a well situated beneath a floating derrick platform heaving relative to the pipe being lowered into the well. The apparatus includes a pipe penetration sensing assembly for sensing the movement of the pipe relative to the derrick platform, a heave sensing apparatus for sensing the movement of the derrick platform relative to a stationary object, such as a riser pipe situated beneath the derrick platform, and a compensation apparatus operable by the pipe penetration and heaving sensing apparatus for nullifying the effect of the heaving movement of the platform relative to the riser pipe.

The pipe penetration sensing apparatus preferably includes a pipe penetration measuring line having one end thereof connected with the pipe to be run into the well. The measuring line moves whenever the pipe moves relative to the derrick platform or the platform moves relative to the pipe. A pipe penetration measuring wheel engaged by the pipe penetration measuring line transmits the movement of the measuring line to the measuring wheel.

Additionally, the heave sensing apparatus includes a heave-responsive line which moves in response to the heaving of the derrick platform relative to the riser pipe. The movements of the heave-responsive line is transmitted to a heave-responsive wheel and are used by the compensation apparatus for nullifying the movements transmitted to the measuring wheel which are due solely to the heaving of the platform.

Also, the heave-responsive wheel has an adjustable circumference so that regardless of the angles of the heave-responsive line and the measuring line relative to the apparatus and the riser pipe, the heaving can be nullified by an operator setting same at the paltform location.

BRIEF DESCRIPTION OF THE DRAWINGS

FIG. 2 is an enlarged elevation view of a portion of the apparatus of FIG. 1;

FIG. 3 is a side view of the portion of the apparatus shown in FIG. 2;

FIG. 4 is an enlarged view of the differential gear assembly, shown partly in phantom, which forms a part of the apparatus of this invention;

DESCRIPTION OF THE PREFERRED EMBODIMENT

Figure 1:
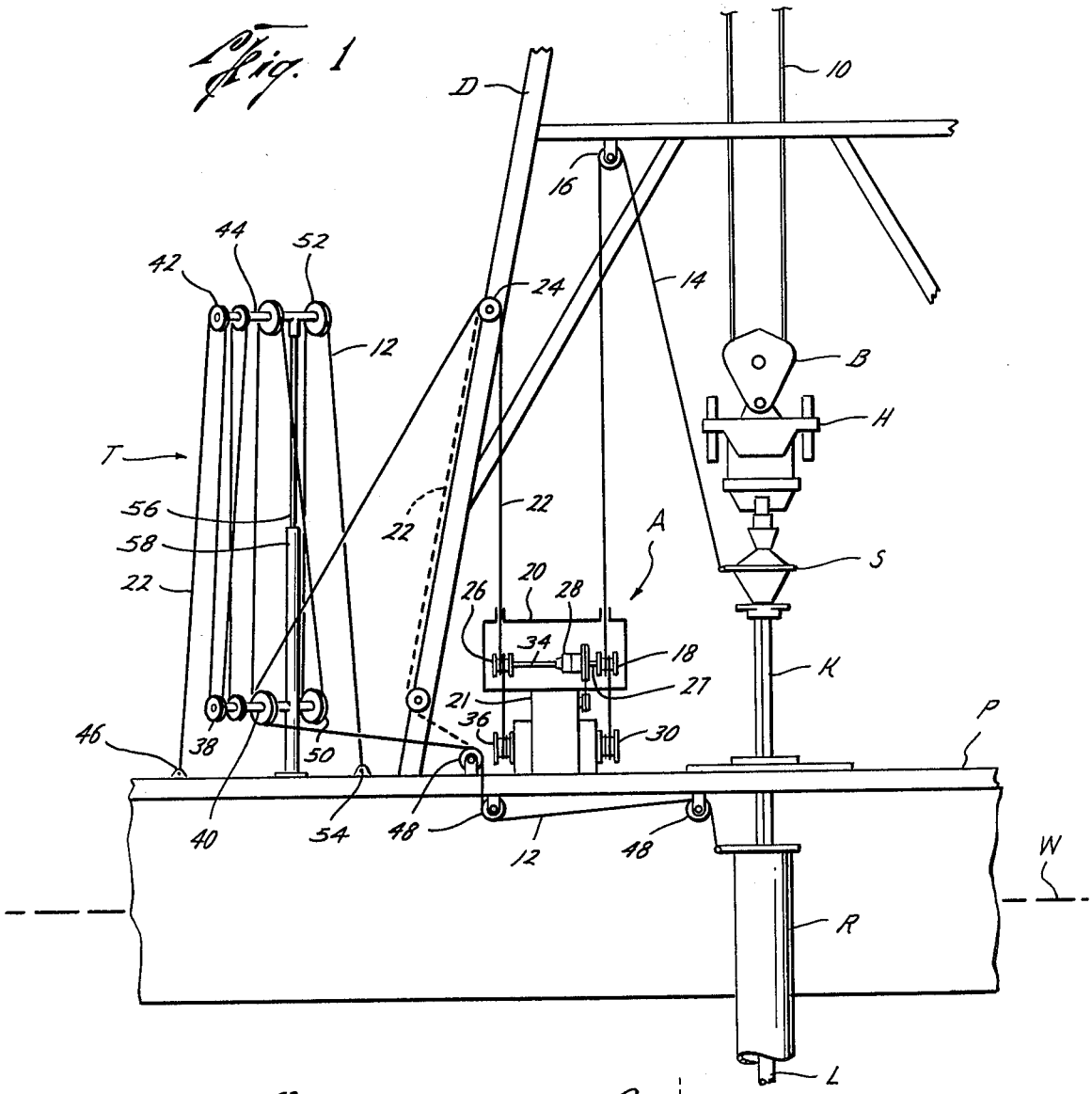
FIG. 1 is an elevational view of the apparatus of this invention in position for use with a floating derrick platform.
Figure 6:
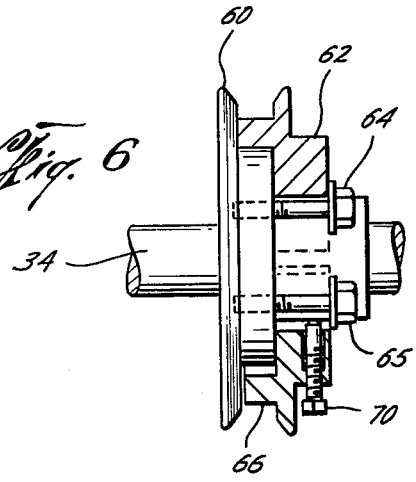
FIG. 6 is a section view of the pulley wheel taken along line 6—6 of FIG. 5.

In the drawings, a portion of a derrick D is shown mounted to a drilling platform P floating in a body of water W, such as the sea, in a position over an offshore well. The derrick D is adapted to run pipe L in and out of the well through a riser pipe R which is mounted at the lower end thereof into the sea floor, thereby making the riser pipe R vertically stationary.

The pipe L is handled in the usual manner for floating derrick platforms P. The pipe L is suspended from a rotatable swivel S which is mounted to a conventional travelling block B through a drill string or heave compensator H, using a conventional kelly K when drilling. The travelling block B, in turn, is suspended from a crown block (not shown) by means of a plurality of lines 10. The heave compensator H is of conventional construction and forms no part of this invention. As is well known, such heave compensator H moves in response to the cyclic up and down motion of the platform P caused by the forces exerted on the platform P by the wave action of the sea, so as to prevent such motion from being transmitted to the kelly K at the upper end of the pipe L, and the pipe L in the well connected thereto. Such up and down motion of the platform is described herein as a "heaving" motion.

Typically, the platform P has a conventional riser tensioner T mounted thereon for exerting a constant tension through a tension line 12 on the stationary riser pipe R to inhibit lateral movement of the riser R relative to the platform P, since the riser R is not attached to the platform or anything else at its upper end.

The letter A generally designates the apparatus of the present invention for automatically compensating for the heaving of the floating platform, which is connected to measuring apparatus for measuring the rate of penetration of pipe P into the well situated beneath the floating derrick platform P. The apparatus A includes a measuring line 14 having one end thereof connected to the swivel S and passing from the swivel S over a suitable pulley 16 on the derrick D downwardly about a measuring wheel 18 of a resultant rotation means or compensator unit 20 mounted on a support 21 mounted to the platform P. The measuring wheel 18 rotates in a manner to be described in response to the longitudinal movement of the pipe length L relative to the derrick platform P. Such a movement occurs whenever the pipe L is actually run into the well but may also occur whenever the platform P heaves about since the heaving motion of the platform is not transmitted to the swivel-held pipe L as a result of the compensating action of the heave compensator H.

A second heave-responsive line 22 having one end thereof connected either to the riser pipe R directly, or indirectly through the riser tensioner T, in a manner to be described, passes over a pulley 24 mounted to the derrick D and then downwardly about a second heave-responsive wheel 26 of the compensation unit 20. The heave-responsive wheel 26 rotates, in a manner to be described, in response to the movement of the derrick platform P relative to the stationary riser pipe R, which is transmitted either directly through the measuring line 22 or indirectly through the tension line 12, riser tensioner T and measuring line 22.

The rotation of the two wheels 18 and 26, in turn, are transmitted to a differential gear assembly 28 within the compensator unit 20 which rotates an amount proportional to the difference in the movements of said measuring wheels. In order for the rotation of the differential gear assembly 28 to be representative of the actual movement of pipe into the well, the measuring wheel 18 and the heave-responsive wheel 26 must rotate distances such that the difference between the two distances is representative of the difference between the actual movement of the pipe L relative to the derrick platform P and the movement of the derrick platform P relative to the riser pipe R. Since the lines 14 and 22 typically move at angles with respect to the pipe L and platform P, the circumference of the heave-responsive wheel 26 may be adjusted so that the differential motion transmitted by the differential gear assembly 28 is zero whenever the pipe L is not moving into the well and is proportional to the actual penetration of the pipe L whenever the pipe L is being run into the well, as will be explained in detail hereinafter.

Considering the apparatus of this invention in more detail, the measuring wheel 18 mounted on a rotatable shaft 27 (FIG. 1) has the measuring line 14 in operable engagement therewith so that movements of the line 14 resulting from the movement of the platform P relative to the pipe L cause rotation of the measuring wheel 22. These movements of the line 14 occur as a result of the heaving motion of the platform P, the actual running of pipe L into the well during drilling operations, or the combined movement resulting from the simultaneous movement of the pipe L into the well and the heaving of the platform P. As illustrated, the measuring line 14 is wrapped about the measuring wheel 18, so as to assure adequate engagement therebetween, so that all movements of the measuring line 14 are converted into rotary movements of the measuring wheel 18. The measuring line 14 is wrapped about measuring wheel 18 so that it preferably rotates in a clockwise manner as viewed from the pipe L whenever the platform P heaves downwardly, for reasons to be described hereinafter.

The measuring line 14 (FIG. 2) extends below the measuring wheel 18 to a reel 30 which wraps up the measuring line 14 so as to constantly exert a pulling force on the line 14 to maintain it under tension at all times. Such tension is preferably maintained by connecting the reel 30 through suitable gears to a motor 32 which is constantly acting in a direction to wind up the measuring line 14 on the reel 30, but which will permit an unwinding of the measuring line 14 if pipe L is being run into the well or if there is the downward movement of the platform P as a result of wave action. The motor 32 may be either a conventional spring-driven motor or an air motor. A suitable air motor is described in detail in U.S. Pat. No. 3,747,218, which description is incorporated herein by reference. It should be noted, however, that other conventional air or spring motors may be used.

For the purpose of illustrating the sensing of the movement of the platform P relative to the riser pipe R, the heave-responsive line 22 may be directly connected between the riser pipe R and the heave-responsive wheel 26, as shown by the dashed line 22. As illustrated, the measuring line 22 is suitably connected to the top of the riser pipe R, extends upwardly at an angle and passes about a plurality of conventional pulleys 48 mounted to the platform P, extends upwardly and passes about pulleys 25 and 24 mounted to the derrick D, and finally extends downwardly about the measuring wheel 22.

The heave-responsive wheel 26 mounted on a rotatable shaft 34 has the heave-responsive line 22 thereof in operable engagement therewith so that the movements of the line 22, in response to the movement of the derrick platform P relative to the riser pipe R, causes rotation of the measuring wheel 26. The line 22 is looped around the wheel 26 so as to insure adequate engagement therebetween so that all movements of the line 22 are converted into rotary movement of the wheel 26. The line 22 is looped about the measuring wheel 26 in the opposite direction, i.e., counterclockwise as viewed from the pipe L in FIG. 1, from the looping of line 14 about measuring wheel 18 so that the heave-responsive wheel 26 rotates in the opposite direction from measuring wheel 18 whenever the platform heaves relative to the riser pipe R for reasons to be described hereinafter.

The line 22 (FIG. 2) also extends from the wheel 26 to a reel 36 which wraps up the line 22 so as to constantly exert a pulling force on the line to maintain it under tension at all times. The tension is preferably maintained in a like manner to the maintenance of tension on measuring line 14 by connecting the reel 36 through suitable gears to the motor 32.

As is evident from FIG. 1, whenever the platform P moves downwardly relative to the riser R, the tension exerted on the line 22 by the riser R becomes less whereas the tension applied to reel 36 remains constant thereby causing the line 22 to move away from the riser R and toward the reel 36, thereby causing the measuring wheel 26 to rotate in a clockwise direction, as viewed from the pipe L. In contrast, the movement of the platform P upwardly increases the tension exerted on the line 22 by the riser R thereby causing the wheel 26 to rotate in the opposite or counterclockwise direction.

In the preferred embodiment, the movement of the platform P relative to the riser pipe R is transmitted to the measuring line 22 indirectly through the tension line 12 and riser tensioner T. As shown in FIG. 1, the measuring line 22 preferably extends about pulley 24 mounted on the derrick D and then alternately about a plurality of pulleys 38 mounted on a lower lateral bar 40 and a plurality of pulleys 42 about an upper lateral support 44 of the riser tensioner T and finally extending downwardly to the platform P where the line 22 is fastened to a suitable anchor 46 mounted thereto.

The tension line 12 is attached in a suitable manner to the riser pipe R, typically extends from the riser pipe R at an angle upwardly about a plurality of pulleys 48 mounted to the platform P, then alternately about a plurality of pulleys 50 mounted on the lower lateral arm 40 of the riser tensioner T and a plurality of pulleys 52 mounted on the upper lateral arm 44 of the riser tensioner T, and subsequently downwardly to the platform P where the tension line 12 is fastened to a suitable anchor 54 mounted thereto.

The upper lateral arm 44 is mounted to a first upright portion 56 of the riser tensioner T and operates as a piston which moves in and out of the lower upright portion or cylinder 58 of the riser tensioner T in response to the application and release of tension on the tension line 12 connected to the riser pipe R. The tension required to move the piston in and out of the tensioner T may be adjusted by adjusting the air pressure of the air confined within the cylinder 58. The riser tensioner T may be any conventional riser tensioner, such as the "Marine Systems" tensioner manufactured by the Rucker Schaffer Company of Houston, Tex.

Whenever the platform P moves upwardly relative to the riser R, the portion of the tension line 12 between the pulley 48 nearest the riser R and the riser R becomes larger thereby forcing the piston 56 of the tensioner riser T downwardly into the cylinder 58. The downward motion of the piston 56, in turn, reduces the tension exerted on the heave-responsive line 22 by the riser tensioner T whereas the tension applied by the reel 36 by the motor 32 remains constant, thereby causing the line 22 to move about the measuring wheel 26 in a clockwise direction, as viewed from the pipe L, and thereby transmitting the motion of the line 22 to the measuring wheel 26.

In contrast, whenever the platform P moves downwardly relative to the riser R, the portion of the tension line 12 between the pulley 48 adjacent the platform and the platform P becomes smaller, thereby releasing the force exerted by the tension line 12 on the tensioner T whereby the compressed air within the cylinder 58 pushes the piston 56 upwardly, and more tension is exerted on the line 22. The line 22, in turn, moves upwardly from the reel 36 and rotates the measuring wheel 26 in a counterclockwise direction, as viewed from the pipe L.

Figure 5:
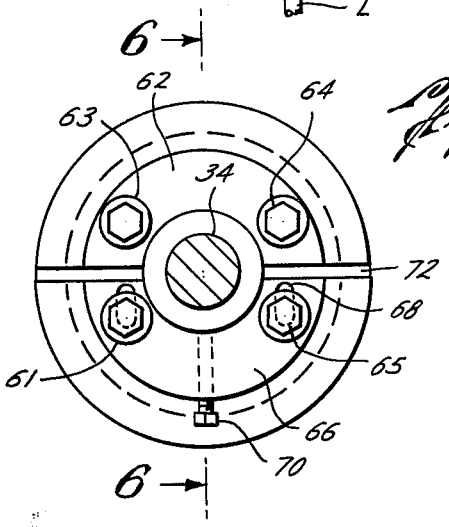
FIG. 5 is an enlarged view of a pulley wheel forming a part of the apparatus of this invention.

Considering the resultant rotation means or compensator unit 20 in more detail, the measuring wheel 18 may be any suitable conventional pulley; however, the heave-responsive wheel 26 preferably has an adjustable circumference for reasons to be described hereinafter. A suitable heave-responsive wheel 26 is the pulley of adjustable circumference shown in detail in FIG. 5 and includes a half pulley 60 rigidly mounted to the shaft 34 of the compensator unit 20. An upper pulley section 62 is mounted against the half pulley 60 by means of a pluralitty of screws 64 and washers 63 through circular holes (not shown) and a lower pulley section 66 is mounted against the pulley half 60 by means of a plurality of screws 65 and washers 67 through elliptical holes 68, shown in phantom in FIG. 5. The elliptical holes 68 in the lower pulley section 66 allows the pulley section 66 to be mounted a variable distance 72 from the upper pulley section 62 and thereby permits the adjustment of the circumference of the pulley. It will be appreciated that the peripheral surface of the wheel 26 engaged by one loop of the heave-responsive line 22 is not necessarily a true circle after adjustment, so the "circumference" refers to the periphery of such wheel 26, whether or not it is a truly circular surface. A set screw 70 also extends through the lower pulley section 66 and may be turned to adjust the distance 72 between the two pulley sections 62 and 66.

The rotary movements of the heave-responsive wheel 26 and the measuring wheel 18, in response to the movements of the lines 22 and 14, respectively, are transmitted through shafts 34 and 27, respectively, to the differential gear assembly 28.

The shaft 34 (FIG. 4) is connected by suitable means to bevel gear 74 (shown in phantom) mounted within the housing 76 of the differential gear assembly 28 and transmits the movements of the wheel 26 thereto. Measuring wheel 18 is connected to bevel gear 78 (shown in phantom) by the shaft 27 which transmits the rotational movement of the measuring wheel 18 to the gear 78. The rotation of the bevel gears 74 and 78 are, in turn, transmitted to pinion gears 80 and 82 (shown in phantom) connected together by a shaft 84. The shaft 84 in turn is suitably mounted with the housing 76 having a resultant rotation pulley 86 rigidly mounted therewith such that the forces exerted on the pinion gears 82 and 84 by the bevel gears are transmitted to the housing 76. Whenever the shafts 34 and 27 rotate in opposite directions, the housing 76 rotates a distance proportional to the difference between the rotation of the bevel gears 74 and 78. Hence, the resultant rotation pulley 86 mounted with the housing 76 also rotates an amount of resultant rotation proportional to the difference in rotation of the measuring wheels 18 and 26. A suitable differential gear assembly may be a conventional differential gear assembly such as manufactured by the Peerless Company.

In order for the resultant rotation of the pulley 86 of the differential gear assembly 28 to be proportional to the actual movement of the pipe L into the well, the rotation of the shaft 34 connected with the heave-responsive wheel 26 and the shaft 27 connected with the meauring wheel 18 must turn equal amounts in opposite directions whenever the platform P is heaving but pipe L is not being run into the well.

The opposing motion of the shafts may be obtained by wrapping the heave-responsive line 22 about the wheel 26 in a direction opposite to the direction of the measuring line 14 about the measuring wheel 18. The circumference of the adjustable heave-responsive wheel 26 usually is adjusted when the pipe L is not being run into the well in order for the shafts to turn equal amounts in opposite directions. This adjustment compensates for the differences in the distances moved by the tension line 12 and the platform P whenever the platform P heaves upwardly or downwardly. This difference in distance is caused by the tension line 12 moving at an angle relative to the actual movement of the platform P relative to the riser pipe P. In addition, the adjustment may compensate for the differences in distances moved by the heave-responsive line 22 and the platform P and also for the differences in distances moved by the measuring line 14 and the pipe L whenever the platform heaves. These differences are also caused by the plurality of angles formed by the measuring line 14 and heave-responsive line 22 relative to the vertical movements of the pipe L and platform P.

A suitable endless belt 88 (FIG. 3) passes about the differential gear pulley 86 and about a pulley 90 of a mechanical indicator or recorder 92 which senses the rotation of the pulley 90 and thereby measures the rotation of the differential gear assembly pulley 86 whenever the indicator 92 is suitably calibrated. The output of the mechanical indicator thus may accurately describe the differential movement between the measuring wheels 26 and 18 and consequently the penetration of pipe into the well. A suitable mechanical indicator is manufactured by the Martin-Decker Company of Santa Ana, Calif.

Alternately, the differential gear assembly pulley 86 may have two belt guides formed therein so that an additional endless belt 94 may be mounted about the pulley 86 and a pulley 96 of an electrical recorder or indicator 98 which generates pulses indicative of the rotation of the pulley 96. The pulses generated may be used by a read-out device capable of counting the pulses to thereby determine the cumulative differential movements of the measuring wheel 18 and 26 and consequently the penetration of pipe into the well. A suitable electrical indicator is manufactured by the Martin-Decker Company of Santa Ana, Calif.

Preferably, clutch-brake assemblies (not shown) may be connected between the pulleys 90 and 96 of the mechanical recorder 92 and electrical recorder 98, respectively, and the main units of the recorders. The clutches of these assemblies may be disengaged by an operator on the platform P to prevent transmission of the movements of the differential gear assembly 28 to the indicators whenever the kelly K is being drawn upward after disengagement of the pipe L in order for another length of pipe L to be attached thereto for subsequent placement into the well, thereby preventing erroneous indications by the indicators of the amount of pipe actually run into the well. Whenever the clutch is engaged, for example during drilling operations, the differential movement of the differential gear assembly is transmitted through the clutch assembly to the indicators. A suitable clutch-brake assembly is described in detail in U.S. Pat. No. 3,747,218, which is incorporated herein by reference. It should be noted, however, that other devices for preventing such transmissions may be used.

In the operation of the apparatus A of the present invention, the apparatus is initially calibrated after being installed on a floating platform P in the manner described above. This calibration is accomplished while the pipe L is not being run into the well.

The movement of the platform P relative to the pipe L as it heaves about is transmitted by the movement of the line 14 to the measuring wheel 18 which rotates in a counterclockwise direction, as viewed from the pipe L, whenever the platform P heaves upwardly relative to the riser R and rotates in a clockwise direction whenever the platform heaves downwardly. The amount of rotation is dependent on the amount of movement of the measuring line 14, which is ordinarily not the same as the distance moved by the platform P due to the movement of the line 14 at angles relative to vertical.

The movement of the platform P relative to the riser R is sequentially transmitted through the tension line 12, riser tensioner T, and the heave-responsive line 22 to the heave-responsive wheel 26 which rotates in a clockwise direction, as viewed from the pipe L, or in the direction opposite to that of wheel 18, whenever the platform heaves upwardly and in a counterclockwise direction, or the direction opposite to that of wheel 18, whenever the platform heaves downwardly. The amount of rotation is dependent on the distance movement by the heave-responsive line 22, which is ordinarily not the same as the distance moved by the platform P due to the movement of the lines 22 and 12 at angles relative to vertical.

The opposite rotating movements of the measuring wheel 18 and heave-responsive wheel 26 are transmitted through shafts 27 and 34, respectively, to the differential gear assembly 28 which rotates an amount proportional to the difference in rotation of the shafts 27 and 34. Since any differential motion which occurs while the pipe L is not being run in or out of the well is due to the heaving of the platform P, an operator may nullify the effect of the heaving motion of the platform by adjusting the circumference of the adjustable heave-responsive wheel 26 until the shafts 27 and 34 turn equal amounts in opposite directions thereby preventing any movement of the differential gear assembly 28.

Whenever the pipe L is being run into the well; i.e., moving relative to the stationary riser pipe R; the measuring line 14 transmits a movement to the measuring wheel 18 of which part is due to the heaving movement of the platform P and part is due to the actual movement of pipe L into the well. The additional rotation of shaft 27 resulting therefrom causes the assembly 28 to rotate an amount proportional to the difference in the amounts of rotation of shafts 27 and 34.

Thus the differential gear assembly 28 functions with the rest of the structure operatively connected thereto to nullify the portion of the movement transmitted to the measuring wheel 18 which is due to the heaving motion of the platform P and to transmit to either or both of the recorders 92 and 98 a movement which is proportional to the actual movement of the pipe L relative to the stationary riser pipe R. The recorders, in turn, convert this movement into a penetration measurement and suitably display same in the conventional well-known manner, which makes it possible to compute the rate of penetration.

The foregoing disclosure and description of the invention are illustrative and explanatory thereof, and various changes in the size, shape, and materials as well as in the details of the illustrated construction may be made without departing from the spirit of the invention.

We claim:

1. A heave compensating apparatus for use in measuring the rate of penetration of drill pipe run into a well situated beneath a floating drilling platform heaving relative to a stationary riser pipe located beneath the platform, wherein a derrick support assembly including a swivel is mounted on such platform for supporting such drill pipe in such riser pipe, comprising:

a first measuring wheel adapted for mounting on such platform and a first measuring line in operable engagement therewith, said first measuring line adapted for extending from said first measuring wheel to such swivel for measuring relative movement between such platform and such drill pipe;

a second measuring wheel adapted for mounting on such platform having a second measuring line in operable engagement therewith, said second measuring line adapted for extending from said second measuring wheel to such riser pipe for measuring relative movement between such riser and such platform;

said first and second measuring lines providing linear responses indicative of relative movement between such platform and such swivel and between such platform and such riser, said measuring wheels being mounted for rotation for converting said linear response into rotational response;

resultant rotation means operatively connecting said first and second measuring wheels for providing a resultant rotation indicative of actual drill pipe movement; and said second measuring wheel being adjustable to a circumference whereby there is no rotation of said resultant rotation means when the platform heaves about and pipe movement relative to the stationay riser pipe is caused only by platform heave.

2. The heave-compensating apparatus of claim 1 wherein said resultant rotation means comprises:

differential means for detecting the difference between the movements sensed by said first measuring wheel and said second measuring wheel, and for transmitting an indication proportional to the movement of the drill pipe relative to the stationary riser pipe only thereby nullifying the effect of movements sensed by said first measuring wheel which are due to the heaving of the platform.

3. The apparatus of claim 2, wherein said differential means comprises:

differential gear means for sensing the difference in the movements between first measuring wheel and said second measuring wheel and for transmitting motion proportional to the movement of the drill pipe with respect to the stationary riser pipe.

4. The apparatus of claim 1, wherein said adjustable measuring wheel comprises:

(a) first section means; and (b) second section means movable relative to said first section means, said second section means including mounting means for mounting said second section means a variable distance from said first section means whereby the circumference of the wheel may be adjusted.

5. The apparatus of claim 1, wherein:

said second measuring line moves at an angle relative to the movement of the heaving platform and said adjustable second measuring wheel is adjusted so that said second measuring wheel rotates a distance sufficient to prevent rotation of said resultant rotation means when the pipe is not moving relative to the stationary riser pipe.

6. The apparatus of claim 1, wherein said first and second measuring lines move at angles relative to the movement of the derrick platform and said second measuring wheel is adjusted whereby said second measuring wheel rotates a distance sufficient to prevent rotation of said resultant rotation means when the pipe is not moving relative to the stationary riser pipe.

7. The heave-compensating apparatus of claim 1, further comprising:

penetration indicating means connected to said resultant rotation means for operation in response to said resultant rotation means for determining the penetration of the pipe into the well.

8. The apparatus of claim 7, wherein said penetration indicating means comprises:

indicator means for indicating the penetration of pipe relative to the stationary riser pipe.

9. The structure set forth in claim 1, wherein said resultant rotation means includes:

a resultant pulley and means connected to said first and second measuring wheels for rotating such resultant pulley an amount of rotational rotation indicative of the actual linear movement of said drill pipe only.

10. The structure set forth in claim 1, including:

said first measuring line moving linearly in response to travel of said drill pipe and vertical movement of such platform relative to said drill pipe and rotating said first measuring wheel in response thereto;

said second measuring line moving linearly in response to vertical movement of such platform and rotating said second measuring wheel in response thereto; and said resultant rotation means including a differential gear assembly connected to said first and second measuring wheels for nullifying the rotation of said first measuring wheel in response to vertical movement or heave of such platform by providing a resultant rotation to a resultant rotating pulley that is the difference in rotational movement of said first and second measuring wheels.

11. The structure set forth in claim 10, including:

said first and second measuring lines being connected to said first and second measuring wheels such that said first and second measuring wheels rotate in opposite directions in response to heave of said platform.

12. The structure set forth in claim 11, wherein:

the amount of rotation of said first and second measuring wheels in response to heave of said platform is in equal but in opposite directions.

* * * * *